US005171128A

United States Patent [19]

Williamson et al.

[11] Patent Number: 5,171,128

[45] Date of Patent: Dec. 15, 1992

[54] FAN WHEEL FOR A FAN OR BLOWER ASSEMBLY

[75] Inventors: Richard D. Williamson, New Brighton; Michael J. Franklin, Apple Valley, both of Minn.

[73] Assignee: Twin City Fan & Blower Co., Minneapolis, Minn.

[21] Appl. No.: 644,310

[22] Filed: Jan. 18, 1991

[51] Int. Cl.[5] ..... F01D 5/14

[52] U.S. Cl. ..... 416/223 B; 416/181

[58] Field of Search ..... 416/178, 179, 181, 182, 416/184, 185, 187, 223 B

[56] References Cited

U.S. PATENT DOCUMENTS 4,531,890 7/1985 Stokes ..... 416/187

FOREIGN PATENT DOCUMENTS 0701562 7/1965 Canada ..... 416/187

*Primary Examiner*—Edward K. Look
*Assistant Examiner*—Christopher M. Verdier
*Attorney, Agent, or Firm*—Kinney & Lange

[57] ABSTRACT

An improved centrifugal fan wheel adapted to receive a flow medium for radially accelerated discharge by plurality radially extending impeller blades. A plurality of flow medium passage channels are positioned radially inwardly of an outer extent of the fan wheel to improve the efficiency of the fan. The flow medium passage channels are defined by alternating cutouts disposed between adjacent blades about the outer extent of a fan wheel back plate.

2 Claims, 1 Drawing Sheet

FAN WHEEL FOR A FAN OR BLOWER ASSEMBLY

BACKGROUND OF THE INVENTION

The present invention relates to a centrifugal fan assembly, and more particularly to an improved centrifugal fan wheel.

Centrifugal fans or blowers are used to move air and/or other gases from one location to another. Typical centrifugal fan applications include air conditioning, ventilation and heating.

Essentially, a centrifugal fan assembly includes a centrifugal fan wheel mounted for rotation in a fan housing or casing. A motor assembly is included to drive the fan wheel. Air (or other flow medium) is drawn into the fan assembly through an inlet to the rotating fan wheel where it is radially accelerated for discharge at an outer extent of the fan wheel. The kinetic and potential energy developed as a result of the rotating action of the fan wheel provides sufficient energy to discharge the flow medium from the fan to the environment.

As air or other flow medium is forced through the fan wheel, the rotating action of the fan wheel is transferred to the air or flow stream as increased static pressure and velocity pressure. Static pressure is essentially a measure of the potential energy of the flow stream. Velocity pressure is a measure of the kinetic energy present in the moving gas stream.

Fan and fan wheel design have become increasingly significant as the cost of energy increases. It is desirable to design a fan or fan wheel which operates more efficiently. Fan efficiency is generally specified in terms of total (or mechanical) efficiency or in terms of static efficiency. Total (mechanical) efficiency is a measure of the total energy in the gas stream as a percentage of the energy input to the fan. Static efficiency relates to the static pressure increase of the flow stream relative to the energy input to the fan.

Thus, it is a continuing goal to design a fan or fan wheel having increased total (mechanical) and static efficiency than those previously constructed.

SUMMARY OF THE INVENTION

The present invention relates to an improved centrifugal fan wheel. More specifically, the improved fan wheel is more efficient. The fan wheel has increased total (mechanical) and static pressure ratings for typical operating ranges and has particular application in a tubular fan assembly.

A centrifugal fan wheel is adapted to drive a flow medium for radially accelerated discharge and includes a plurality of radially extending impeller blades. Typically, the blades of the fan wheel are supported between a front plate and a back plate. The improvement of the present invention is the provision of a plurality of flow medium passage channels positioned inwardly of the outer extent of the fan wheel. The flow medium passages provide increased mechanical efficiency and static efficiency for the fan assembly.

DETAILED DESCRIPTION OF THE PREFERRED EMBODIMENT

The present invention provides a centrifugal fan wheel with improved efficiency for typical operating ranges. The fan wheel of the present invention has particular application to a tubular fan assembly. Air or other flow medium is drawn into the fan and radially accelerated by the rotating fan wheel. Thereafter, the accelerated air or flow medium is discharged from the fan to an outside environment.

Figure 1:
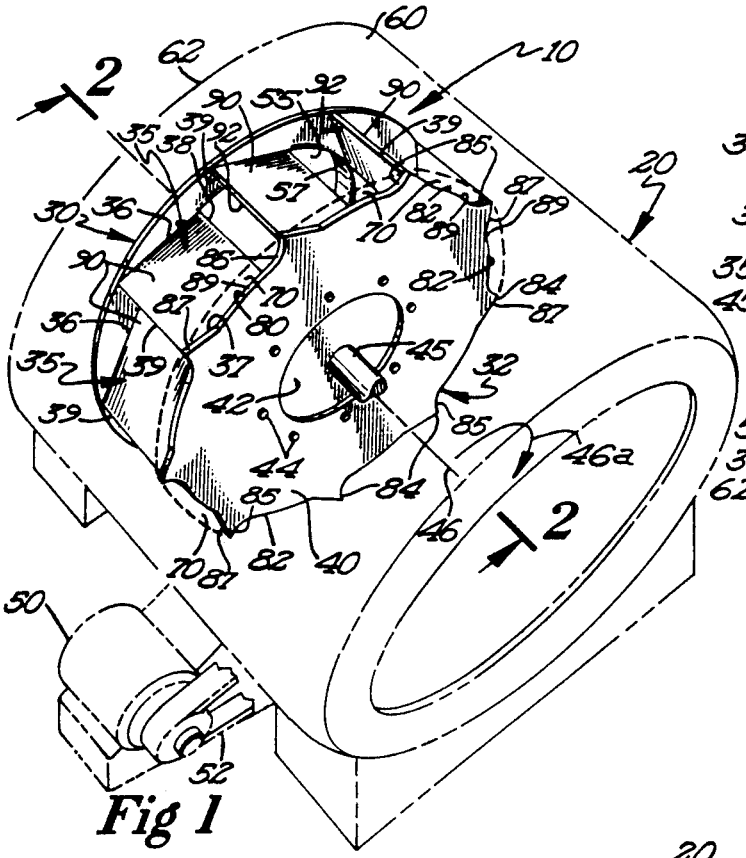
FIG. 1 is a perspective view of a tubular fan broken away in section to expose a centrifugal fan wheel in accordance with the present invention.
Figure 3:
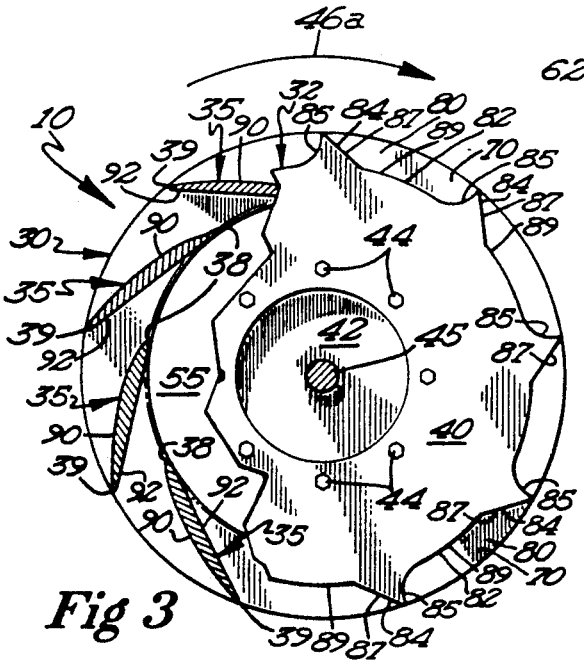
FIG. 3 is a rear elevation view of the centrifugal fan wheel of FIG. 1 shown with a portion of a back plate broken away to expose several of the blades and a portion of a front plate.
Figure 2:
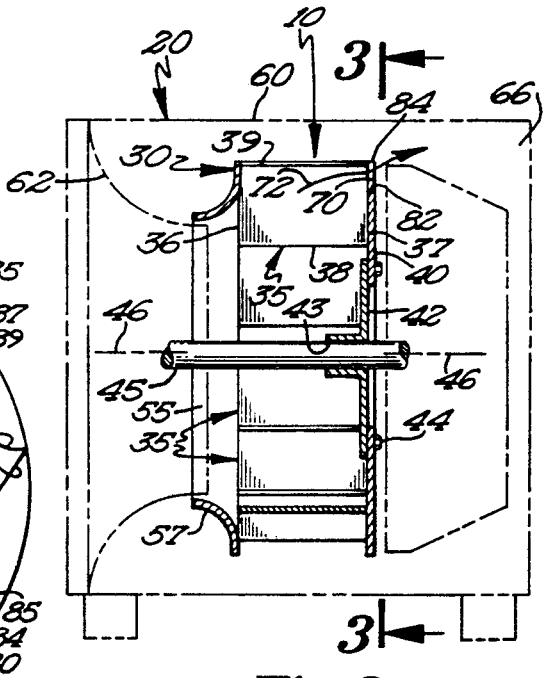
FIG. 2 is a cross-sectional view taken along line 2—2 of FIG. 1.

Referring to FIGS. 1, 2 and 3, a centrifugal fan wheel 10 in accordance with the present invention includes an annular front plate 30, a back plate 32 and a plurality of radially extending impeller blades 35. The blades 35 are air foil blades (generally known in the industry) or alternatively may be flat blades, also known. As shown, the front plate 30 is generally parallel to and spaced from the back plate 32 (FIG. 1). The impeller blades 35 each have a first lateral edge 36 supported by the front plate 30 and a second lateral edge 37 supported by the back plate 32. Generally the lateral edges 36 and 37 of the blades are welded to the front plate 30 and back plate 32, respectively. The impeller blades 35 also have a leading edge 38 and a trailing edge 39.

The back plate 32 is formed of an annular member 40 having a central hub 42 attached to the annular member 40 by a plurality of screw/bolt attachments 44. Alternatively, the central hub 42 may be welded to the annular member 40. The central hub 42 has a central bore 43 (FIG. 2) adapted to receive a drive shaft 45 therethrough. The central bore 43 and shaft 45 define a rotation axis 46 for the fan wheel 10.

In accordance with the present invention (FIGS. 1, 2 and 3), axial flow passage channels 70 are provided radially inwardly from the outer extent of the fan wheel 10. A fan wheel 10 having such axial flow passage channels is more efficient than known fan wheels without such channels—a fan wheel similar to the fan wheel illustrated in FIG. 4 and discussed below, for example.

A drive motor 50 provides energy to drive the shaft 45 and mechanically rotate the fan wheel 10 about the rotation axis 46 in a conventional flow direction indicated by arrow **46*a* (FIGS. 1 and 3), in known manner. The energy provided by the motor 50 is transferred to the drive shaft 45 via a pulley assembly 52. The drive shaft 45 and fan wheel 10 are coupled to rotate with each other. Accordingly, the energy generated by the motor 50 is transferred to the flow medium forced through the fan 20 by virtue of the rotation of the fan wheel 10 about the rotation axis 46**.

Air or other flow medium is drawn into the fan wheel 10 at a central inlet 55 through the annular front plate 30. The rotation of the fan wheel 10 by the drive shaft 45 causes the flow medium to be radially accelerated through the fan wheel 10. That is, the flow medium is radially forced from the leading edge 38 of each blade 35 towards the trailing edge 39 where it is released from the fan wheel 10 at an outer extent thereof. The front plate 30 may include a curved collar 57 to direct the flow medium through the inlet 55 of the front plate 30, in known manner (see FIG. 2).

As illustrated in FIGS. 1 and 2, the fan wheel 10 is suitable for use in a tubular fan assembly 20 formed of a cylindrical fan casing 60 which extends in general alignment with the rotation axis 46 of the fan wheel 10. Air or other medium is introduced into the tubular fan 20 at a fan assembly inlet 62 at an end of the cylindrical fan casing 60. The flow medium is directed essentially towards the fan wheel 10 spaced from the fan assembly inlet 62. A conventional inlet funnel (as shown in FIG. 2) directs the air or other medium towards the fan wheel inlet 55 where it is drawn through the fan wheel inlet 55 and forced through the fan wheel 10. The flow medium is radially accelerated by the rotating impeller blades 35 and released at the outer extent of the fan wheel 10. The rotating action of the blades 35 increases the static and velocity pressure of the flow medium forced therethrough.

After the flow medium is discharged from the fan wheel 10, the flow direction of the medium must shift from radial to axial to flow through the fan casing 60 for discharge to the environment. Typically, this axial flow is in alignment with the rotation axis 46. The energy developed as a result of the rotating fan wheel 10 carries the flow stream axially along a remaining extent 66 of the fan casing 60 for discharge to the environment. The axial flow path along the remaining extent 66 of the fan is defined between the fan casing 60 and a discharge cylinder in conventional manner as shown in FIG. 2.

Figure 4:
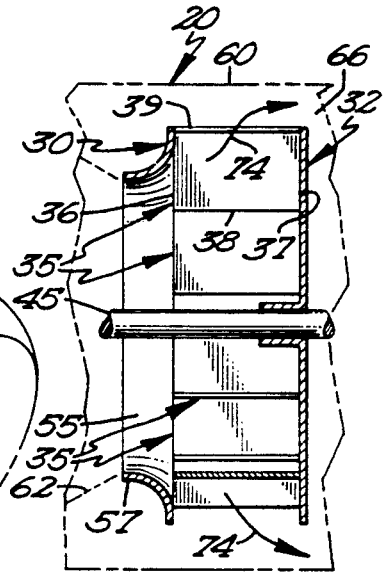
Fig 4 PRIOR ART
FIG. 4 is a side elevation view, shown in cross-section, of a centrifugal fan wheel similar to those previously known in the industry.

In accordance with the present invention, axial flow passage channels 70 are provided at an outer extent of the back plate 32 as shown in FIGS. 1 and 3. In a tubular fan assembly 20, as noted above, the flow direction shifts from radial to axial at the outer extent of the fan wheel 10. This directional shift dissipates some of the energy introduced to the flow stream by the rotating fan wheel 10. In particular, turbulence and other affects are introduced as a result of the directional shift which reduce the available energy maintained by flow system. As a consequence, less energy is available to carry the flow medium along the remaining extent 66 of the fan 20 for discharge to the environment. The flow passage channels 70 of the present invention provide for a transition from radial flow to axial flow inwardly of the outer extent of the fan wheel and result in improved fan efficiency. It is believed that the improved efficiency is provided by a more efficient transition from radially directed flow to axially directed flow at the outer extent of the fan wheel 10. That is, some of the air is released (represented by Arrow 72) from the fan wheel 10 of the present invention inwardly of the outer extent of the fan wheel 10 and therefore does not need to negotiate a sharp turn at or beyond the outer extent of the fan wheel 10. This may also facilitate the transition of that portion of the air discharged at the outer extent of the fan wheel. In contrast, as shown in FIG. 4, in known fan wheels, air is released from the fan wheel only at the outer extent to be forced through a sharp transition as generally illustrated by Arrow 74.

A fan wheel in accordance with the present invention may be constructed by modifying a known fan wheel construction. For example, a round back plate 32 similar in diameter to the front plate 30 (a conventional fan wheel configuration) may be modified to define axial flow passage channels 70 (pre-modified back plate 32 is represented in phantom in FIG. The round back plate 32 is modified by defining alternating cutouts 80 along the outer perimeter of the back plate 32 between adjacent blades 35. The alternating cutouts 80 define a plurality of recessed portions 82 between adjacent blades 35 separated by blade support extensions 84. The blade support extensions 84 correspond to the placement and inclination of the blades 35 and extend generally along a portion of the second lateral edge 37 to the outer extent of the fan wheel 10. The recessed portions 82 define the axial flow passage channels 70 while the blade support extensions 84 provide support for the blades to maintain the structural integrity of the fan wheel 10. The blades 35 are welded to the blade support extensions 84 along the second lateral edge 37. Other fan wheels may be designed to include axial flow passage channels 70 along the outer extent of the fan wheel and are considered within the scope of the invention.

Beginning with a conventional round back plate 32, the cutouts 80 can be formed to define recessed portions 82 having a first side 85, a second side 87 and a base 89. The base 89 forms an arc shaped edge radially inward from the outer extent of the back plate 32. The arc shaped edge of the base 89 extends generally between a lower blade surface 90 of one blade to an upper blade surface 92 of an adjacent blade 35. The first side 85 of each recessed portion 82 curvedly extends between an outer extent of the back plate 32 to the base 89. The second side 87 extends between the base 89 and the outer extent of the back plate 32 in general alignment with the inclination of the blade 35. The first side 85 and second side 87 formed as described define generally tapered blade support extensions 84 between adjacent recessed portions 82. The fan wheel 10 of the present invention provides increased total (mechanical) and static efficiency for typical operating ranges particularly in a tubular fan assembly. Although the present invention has been described with reference to a preferred embodiment, workers skilled in the art will recognize that changes may be made in form and detail without departing from the spirit and scope of the invention.

What is claimed is:

1. A fan wheel for a centrifugal fan of the type adapted to receive a flow medium for radially accelerated discharge, the fan wheel comprising:

an annular front plate having a central inlet therethrough;

a generally circular back plate adapted to receive a drive shaft through a central axis thereof to define a rotation axis for the front plate and the back plate, the back plate being generally parallel to and spaced from the front plate;

a plurality of radially extending impeller blades arranged circumferentially around the rotation axis, the blades being supported by the cooperation of the front plate and the back plate at first and second lateral edges thereof; and further comprising a plurality of recessed portions disposed between adjacent blades along an outer extent of the back plate only, the recessed portions defining axial flow medium discharge channels for discharging radially accelerated flow medium.

2. A fan wheel for use in a tubular fan assembly wherein the fan wheel is supported for operation in a tubular casing and flow medium enters the casing at a fan assembly inlet and is directed axially toward the fan wheel, radially accelerated by the fan wheel and redirected axially to flow along a remaining extent of the casing for axial discharge from the fan assembly, the fan wheel comprising:

an annular front plate having a central inlet therethrough;

a generally circular back plate adapted to receive a drive shaft through a central axis thereof to define a rotation axis for the front plate and the back plate, the back plate being generally parallel to and spaced from the front plate;

a plurality of radially extending impeller blades arranged circumferentially around the rotation axis, the blades being supported by the cooperation of the front plate and the back plate at first and second lateral edges thereof;

axial flow discharge channels associated with the back plate positioned radially inwardly of an outer extent of the fan wheel for redirecting the radially accelerated flow medium for axial flow along a remaining extent of the casing for axial discharge; and an outer extent of the front plate defining an outer extent of the fan to direct radially accelerated flow toward the axial flow discharge channels for axial discharge from the fan assembly, wherein the back plate includes a plurality of recessed portions disposed between adjacent blades along an outer extent of the back plate only, the recessed portions defining the axial flow medium discharge channels for discharging radially accelerated flow medium for axial flow along the remaining extent of the casing for discharge from the fan assembly.

* * * * *

UNITED STATES PATENT AND TRADEMARK OFFICE

CERTIFICATE OF CORRECTION

PATENT NO. : 5,171,128

DATED : December 15, 1992

INVENTOR(S) : RICHARD D. WILLIAMSOM, MICHAEL J. FRANKLIN

It is certified that error appears in the above-identified patent and that said Letters Patent is hereby corrected as shown below:

Item [56]
On the title page, in the References Cited Section, under U.S. PATENT DOCUMENTS, insert the following:

| | | | |
|---|---|---|---|
| 2,287,853 | 6/1942 | Allardice | 230/128 |
| 2,653,755 | 9/1953 | Kruhmin | 230/134 |
| 3,091,384 | 5/1963 | Delaney | 230/134 |
| 3,186,069 | 6/1965 | Mayne | 29/156.8 |
| 3,692,428 | 9/1972 | Bubb et al | 416 187 |
| 4,662,830 | 5/1987 | Pottebaum | 417/424 |
| 4,874,293 | 10/1989 | Gutzwiller | 416/284 |

Signed and Sealed this

Nineteenth Day of October, 1993

Bruce Lehman

*Attest:*

BRUCE LEHMAN

*Attesting Officer*

*Commissioner of Patents and Trademarks*